US006994344B2

(12) United States Patent
Kitaygorodskiy et al.

(10) Patent No.: US 6,994,344 B2
(45) Date of Patent: Feb. 7, 2006

(54) HISTORICAL WAR GAME WITH FLAT SOLDIERS AND METHOD OF PLAYING IT

(76) Inventors: Gennadiy Kitaygorodskiy, 1845 Ocean Ave. #6M, Brooklyn, NY (US) 11230; Aleksandr Temnorod, 1890 E. 5th St. #1R, Brooklyn, NY (US) 11233

( * ) Notice: Subject to any disclaimer, the term of this patent is extended or adjusted under 35 U.S.C. 154(b) by 145 days.

(21) Appl. No.: 10/051,741

(22) Filed: Jan. 22, 2002

(65) Prior Publication Data

US 2003/0155712 A1 Aug. 21, 2003

(51) Int. Cl.
*A63F 3/00* (2006.01)

(52) U.S. Cl. ..... 273/255; 273/236; 273/262

(58) Field of Classification Search ..... 273/236, 273/243–245, 255, 258–259, 261–262, 288, 273/292, 293

See application file for complete search history.

(56) References Cited

U.S. PATENT DOCUMENTS

| | | | | | |
|---|---|---|---|---|---|
| 2,313,303 | A | * | 3/1943 | Szatrow | 273/262 |
| 2,799,504 | A | * | 7/1957 | Keyko | 273/260 |
| 3,466,044 | A | * | 9/1969 | Somerville | 273/262 |
| 3,811,679 | A | * | 5/1974 | Benge | 273/258 |
| 3,831,944 | A | * | 8/1974 | Upton | 273/262 |
| 3,857,568 | A | * | 12/1974 | Yoder | 273/245 |
| 4,055,346 | A | * | 10/1977 | Garcia-Kuenzli | 273/262 |
| 4,093,236 | A | * | 6/1978 | Hoffa | 273/255 |
| 4,184,680 | A | * | 1/1980 | Gage | 273/356 |
| 5,415,411 | A | * | 5/1995 | Peterson | 273/237 |
| 5,465,973 | A | * | 11/1995 | Anderson | 273/262 |
| 5,879,005 | A | * | 3/1999 | Baca | 273/255 |

OTHER PUBLICATIONS

DIA Joint Military Intelligence College, Bolling AFB, DC, The applicability of Commercial Conflict Simulations to Militay Intelligence Training and Education, 1995, 18 pages.*

A Fistful of TOWs 2: Ty Beard, Nuclear Weapons of FFT, 2000, 4 pages.*

* cited by examiner

*Primary Examiner*—Jessica Harrison
*Assistant Examiner*—Alex F. R. P. Rada, II

(57) ABSTRACT

The game is conducted on a flat surface, for example, a floor, with flat pieces which depict warriors, war animals, standards, weaponry, military equipment and fortifications, each typical to a corresponding historical period. The opposing players take turns during which they imitate the shooting using models of projectiles and a special device, and movement of game pieces. When a physical contact between opposing units occurs, hand-to-hand combat takes place, which is decided by a throw of standard playing dice. The rules for administering a battle military action and rules for evaluation of military actions regulate the manner in which the game is carried out according to a chosen historical period and serve in eventual determination of a winner.

10 Claims, 5 Drawing Sheets

HISTORICAL WAR GAME WITH FLAT SOLDIERS AND METHOD OF PLAYING IT

FIELD OF THE INVENTION

The present invention relates to war games, which reenact real military action using a set of game pieces, more particularly relates to war games that are conducted on a flat surface with flat game pieces.

BACKGROUND OF THE INVENTION

There exist a lot of war games conducted on a flat surface (see U.S. Pat. No. 3,998,463 to Zumchak, Joseph; U.S. Pat. No. 4,055,346 to Havlik, Vaclav; U.S. Pat. No. 4,149,316 to Matrin, Spencer; U.S. Pat. No. 4,232,864 to Yavorskiy, James; U.S. Pat. No. 4,560,170 to Enyi, Donatus; U.S. Pat. No. 6,241,251 to Trifonov, Plamen). They, however, have several shortcomings, such as difficulty of replacing damaged game pieces, a large degree of speculation, a lack of connection to a certain historical period, and, as a result, a lack of educational value.

The present invention eliminates those shortcomings and allows players to reenact battles with lifelike rules that closely relate to certain historical periods, such as accurate army contingents, attire, equipment and ammunition and overall methods of war craft. Materials from which game pieces are made are readily accessible, which allows players to easily replace lacking or damaged pieces and/or vary the configuration of their "army". During the game and while getting acquainted with its rules, players get to know all the aspects of war craft of peoples who lived at a certain age in history, an experience which undoubtedly has educational value. The method proposed below allows for a greater accuracy in reenactment of different aspects of war craft, such as troop movement, shooting, hand-to-hand combat, strategic maneuvers, personnel losses and territorial acquisitions, and also in reenactment of wars each consisting of several battles.

SUMMARY OF THE INVENTION

It is the primary object of present invention to provide two or more players with a game, which allows them to simulate battles and/or wars, which consist of several battles, and also means for administering those simulated battles. The game set contains flat pieces that depict all components associated with military action: warriors, war animals, standards, weaponry, military equipment and fortifications, made of readily available material, such as paper, cardboard or plastic. The game is conducted on a smooth flat surface, for example, a floor. The rules of the game account historically authentic data concerning size and configuration of detachments, maximum distances for unit movement, effective radii for projectile weapons and their projectiles and relative efficiency of attack and defense of different units depending on their armor and rank. The rules also reflect specificity of war craft during certain historical periods.

The models of projectiles used during shooting are made of wood, cardboard or plastic. During "shooting", the model is placed on a special flat support, which can also be put at a certain angle, and then a player "shoots" it by clicking on the model with a finger. The game set also includes a device for measuring distances in a form of a ruler with marks, made according with distances different units can move per turn, and also a device for measuring effective radii of said projectiles, in a form of a flat transparent sheet made, for example, from plastic, with marks on it that correspond to initial point of reference and concentric circles each indicating different degrees of "damage" delivered, which are specified for every projectile.

With the help of described game set players can simulate battles, which may be linked into wars. Thus the game simulates the wide spectrum of military actions typical for different historical periods.

DETAILED DESCRIPTION OF THE PREFERED EMBODIMENT

Figure 6:
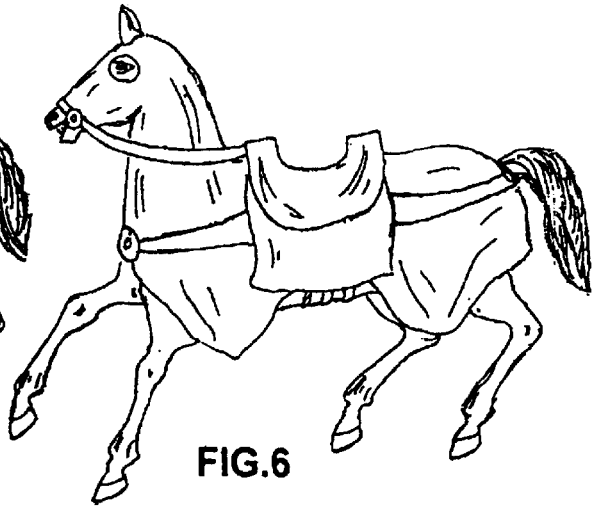
FIG. 6 is a medium-armored horse.
Figure 7:
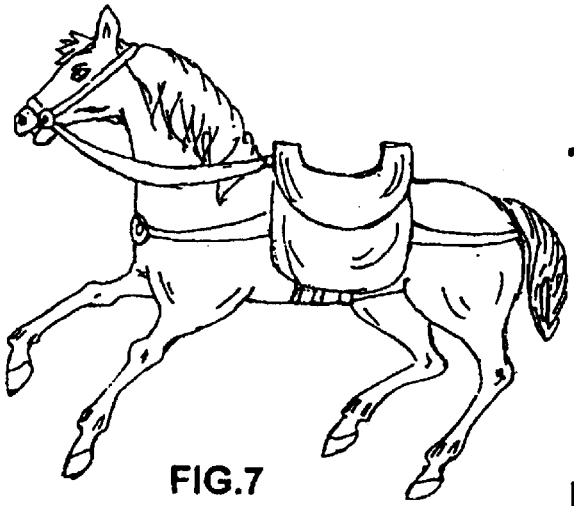
FIG. 7 is a light-armored horse.
Figure 8:
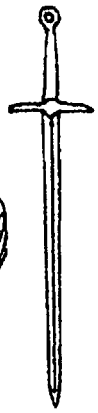
FIG. 8 is a two-handed sword.
Figure 9:
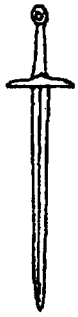
FIG. 9 is a sword for a heavy-armored infantry/cavalry-man.
Figure 10:
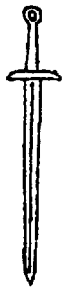
FIG. 10 is a sword for a light-armored infantryman.
Figures 11, 12, 13, 14, 15, 16, 17, 18, 19, 20, 21, 22, 23, 24, 25, 26, 27, 28:
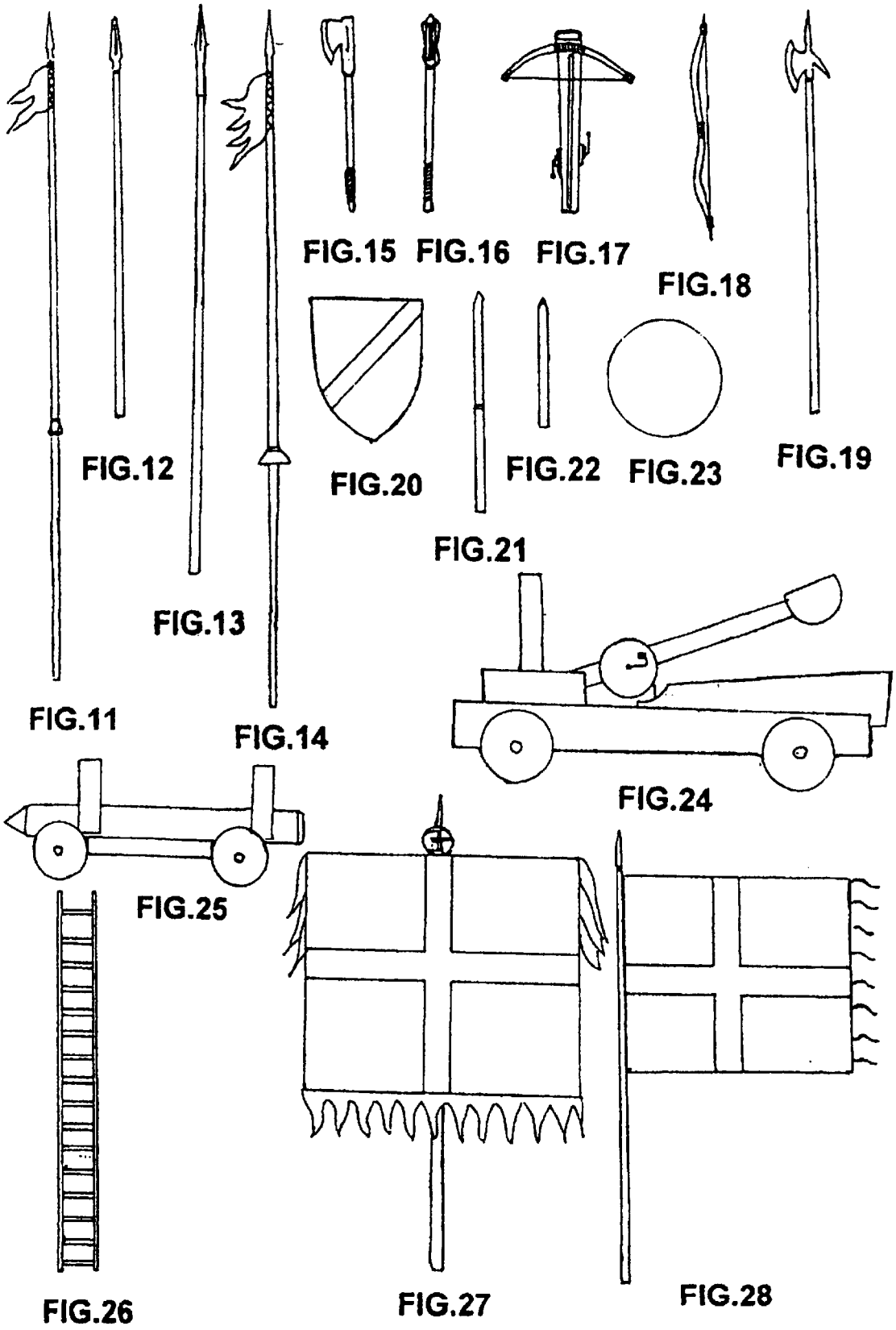
FIG. 11 is a squire's lance.
FIG. 12 is a short spear for a light-armored infantry/cavalry-man.
FIG. 13 is a long spear for a heavy-armored infantryman.
FIG. 14 is a knight's lance.
FIG. 15 is a battle-ax.
FIG. 16 is a mace.
FIG. 17 is a crossbow.
FIG. 18 is a bow.
FIG. 19 is a halberd.
FIG. 20 is a shield.
FIG. 21 is a bow arrow.
FIG. 22 is a crossbow arrow.
FIG. 23 is a catapult projectile.
FIG. 24 is a catapult.
FIG. 25 is a battering ram.
FIG. 26 is a siege ladder.
FIG. 27 is a standard for a large detachment.
FIG. 28 is a standard for a medium detachment.
Figure 29:
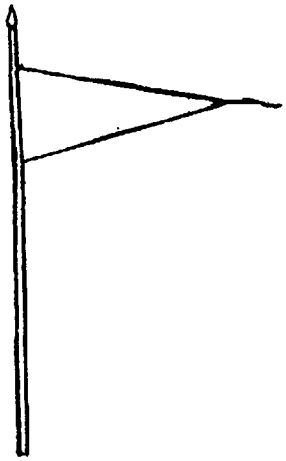
FIG. 29 is a standard for a small detachment.
Figure 30:
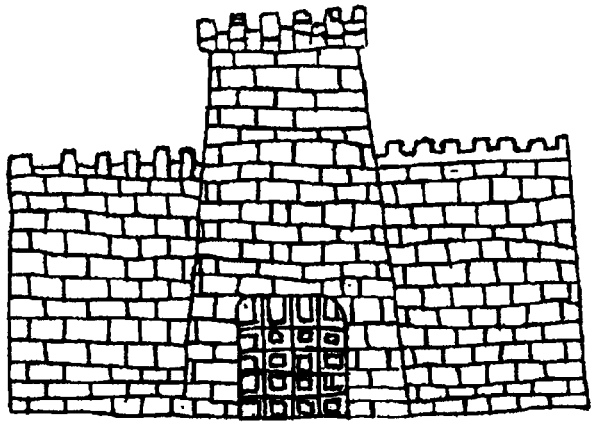
FIG. 30 is a castle wall.
Figure 31:
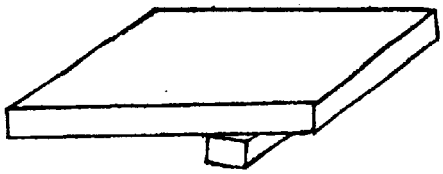
FIG. 31 is a device for imitation of shooting.
Figure 32:
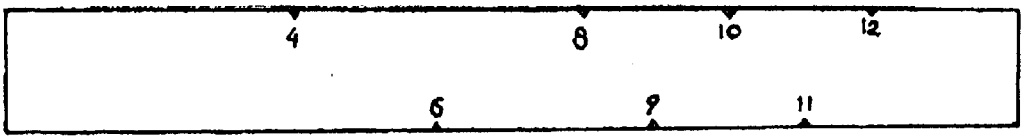
FIG. 32 is a device for measurement of displacement of units.
Figure 33:
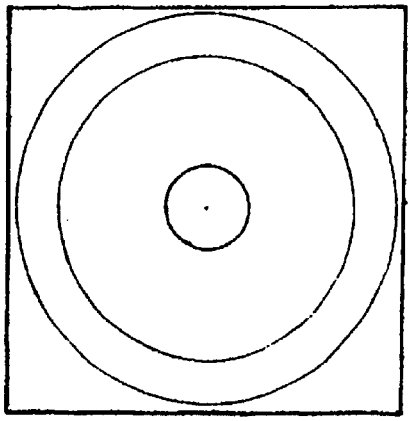
FIG. 33 is a device for measurement of damage delivered by projectiles.
Figure 34:
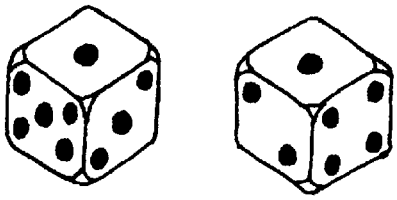
FIG. 34 is a standard six-sided die.
Figure 35:
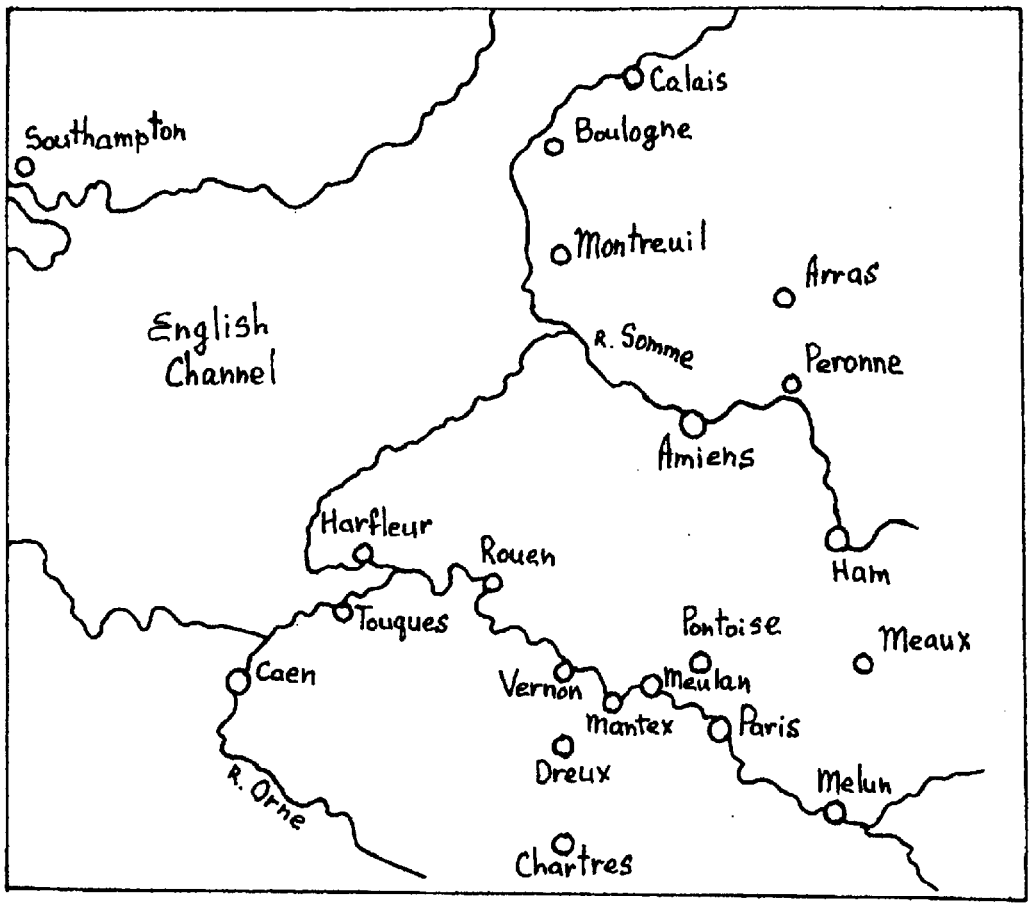
FIG. 35 is a random topographical map.
Figure 36:
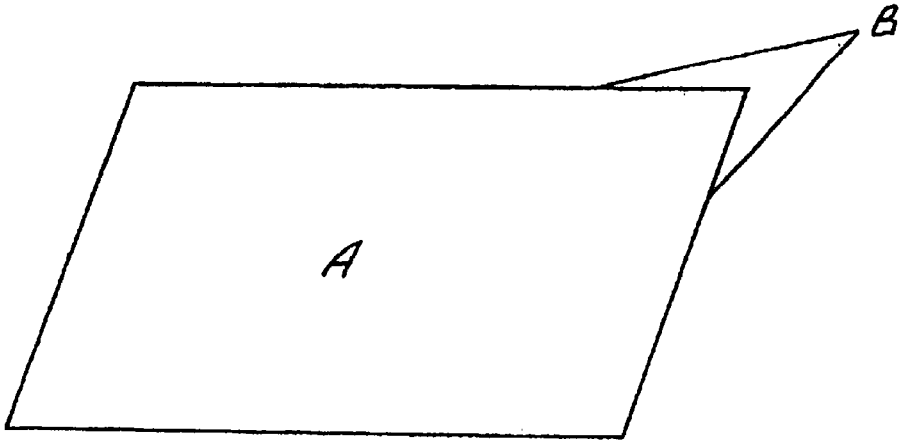
FIG. 36 is a battlefield.
Figure 37:
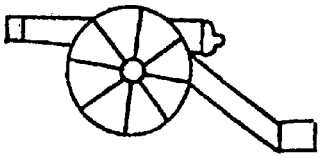
FIG. 37 is a cannon.
Figure 38:
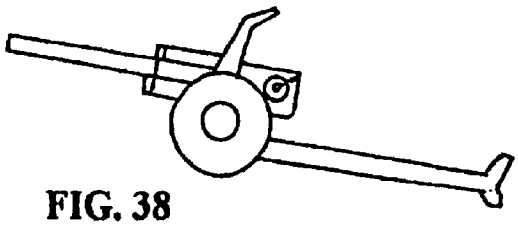
FIG. 38 is a howitzer.
Figure 39:
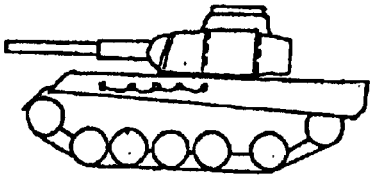
FIG. 39 is a tank.
Figure 40:
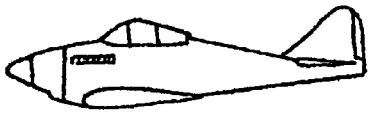
FIG. 40 is an airplane.
Figure 41:
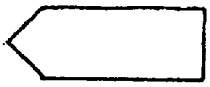
FIG. 41 is a gun projectile.
Figure 42:
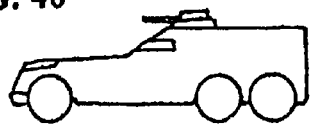
FIG. 42 is a light-armored vehicle.
Figure 43:
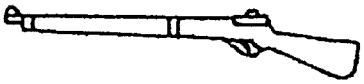
FIG. 43 is a rifle.
Figure 44:
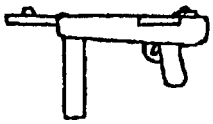
FIG. 44 is a machine-gun.
Figure 45:
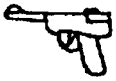
FIG. 45 is a pistol.

A game for at least two players, which represent the opposing sides, in accordance with the present invention, is conducted on a smooth floor, part of which is designated as a battlefield (FIG. 36*a*), and is indicated with, for example chalk lines (FIG. 36*b*). Said game contains a set of flat game pieces made of paper which represent figures of warriors 2–2½ inches long (FIGS. 1–4), war animals (FIGS. 5–7), and also figures depicting standards (FIGS. 27–29), military equipment and armaments (FIGS. 8–26), fortifications (FIG. 30), corresponding to the second half of the $14^{th}$ century—first quarter of $15^{th}$ century and proportionally equivalent to the size of figures of warriors. Shooting is conducted with models of projectiles—bow/crossbow arrows (FIGS. 21–22) and stone or flaming catapult projectiles (FIG. 23) with a help of the device for imitation of shooting (FIG. 31). The intervals of movement of different types of units are measured with a help of the device for measurement of displacement of units (FIG. 32), and a damage zone is measured with a help of the device for measurement of damage area delivered by projectiles (FIG. 33). The area where the war takes place is shown on a topographical map (FIG. 35). Hand-to-hand combat is conducted using a number of standard six-sided dice (FIG. 34).

Below (in the table of weapons and equipment) is given a list of weapons, equipment and standards utilized during battles in medieval Europe and their dimensions accepted in this game.

The model for the bow arrow (FIG. 21) has a length of approximately 1½ inch with a tapered front end. The mentioned tapered front end (approximately ¾ inch long) is the "active part" of the arrow, which delivers damage to the units on the field. The model for the crossbow arrow (FIG. 22) also has a tapered end, and the entire length of the arrow (about ¾ inch) is considered an "active part" that delivers damage. The model for a catapult projectile (FIG. 23) is a circle with a diameter of approximately ¾ inch. The device for imitation of shooting (FIG. 31) is a flat 3×6 inches support ¼–½ inches thick. The game set also includes real or simulated topographical maps and standard playing dice.

Figure 1:
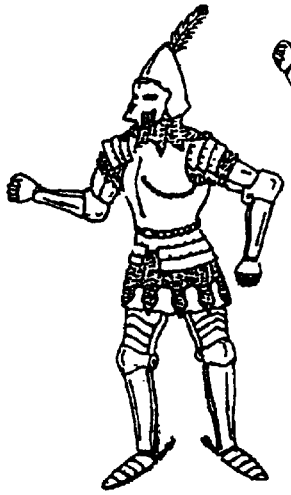
FIG. 1 is a cavalry or infantry knight.
Figure 2:
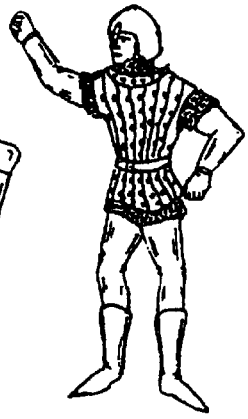
FIG. 2 is a light-armored cavalryman or infantryman
Figure 3:
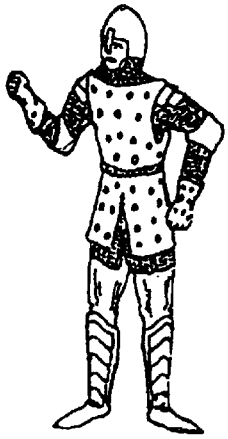
FIG. 3 is a heavy-armored infantryman.
Figure 4:
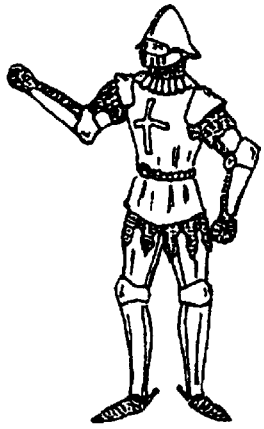
FIG. 4 is a squire.
Figure 5:
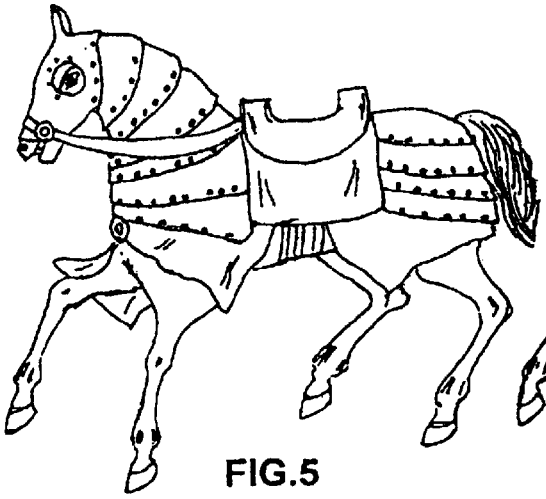
FIG. 5 is a heavy-armored horse.

The set of pieces for administering simulated medieval battles contains figures of infantry and cavalry knights (FIG. 1), light-armored infantry/cavalrymen (FIG. 2), heavy-armored infantrymen (FIG. 3), squires (FIG. 4), light-armored horses (FIG. 7), medium-armored horses (FIG. 6) and heavy-armored horses (FIG. 5).

Table of Weapons and Equipment

| Weapons, Fortifications and Standards | Representative Dimensions (inches) |
|---|---|
| Sword for a squire or for heavy-armored infantryman | 1½ |
| Two-handed sword | 2 |
| Battle ax, mace | 1¼ |
| Halberd | 3 |
| Squire's lance | 5 |
| Knight's lance | 6 |
| Short spear | 3 |
| Long spear | 4 |
| Shield | 1 × ¾ |
| Sword of light-armored infantryman | 1 |
| Crossbow | 1⅜ × 1 |
| Bow | 1½ |
| Catapult projectile | ¾ |
| Catapult | 7 × 5 |
| Castle (bricks) | 2 × 1 |
| Battering ram | 6 × 3 |
| Siege ladder | 5 × 1 |
| Small detachment standard (triangle) | 1½ × 1⅛ |
| Medium detachment standard (rectangle) | 1½ × 1¼ |
| Large detachment standard (rectangle) | 2 × 1½ |

Cavalry knights (FIG. 1) can ride medium-armored horses (FIG. 6) or heavy-armored horses (FIG. 5); light-armored cavalrymen (FIG. 2) can ride light-armored horses (FIG. 7) or medium-armored horses (FIG. 6), while squires (FIG. 4) can ride all three types of horses. A heavy-armored horse (FIG. 5) is covered with metal armor; a medium-armored one (FIG. 6) is covered with trappings, while a light-armored one (FIG. 7) has no armor at all.

In the game, three types of detachments are present: regular troops and cavalry/infantry troops.

The configurations of medieval troops for regular and cavalry/infantry detachments are given in the following table of configuration of detachments.

Table of Configuration of Detachments

| Type of Detachment | Size of Detachment | Configuration: Regular detachments | Infantry detachments | Cavalry detachments |
|---|---|---|---|---|
| Small detachment | From 3 to 10 units | 1 knight<br>1–2 squires<br>1–7 infantrymen | 1 knight<br>—<br>2–9 infantrymen | 1 knight<br>1–2 squires<br>1–7 cavalrymen |
| Medium detachment | From 11 to 25 units | 2–3 knights<br>2–7 squires<br>7–15 infantrymen | 2–3 knights<br>—<br>9–22 infantrymen | 2–3 knights<br>2–7 squires<br>7–15 cavalrymen |
| Large detachment | From 26 to 50 units | 4–7 knights<br>4–16 squires<br>18–27 infantrymen | 4–7 knights<br>—<br>22–43 infantrymen | 4–7 knights<br>4–16 squires<br>18–27 cavalrymen |

The intervals of maximum displacement (in any direction) per turn for all units are given in the following table of intervals of displacement of units.

Table of Intervals of Displacement of Units

| Type of Unit | Type of Battle Horse | Interval (inches/turn) |
|---|---|---|
| Infantry knight | — | 4 |
| Heavy-armored infantryman | — | 6 |
| Light-armored infantryman | — | 8 |
| Light-armored cavalryman | Heavy-armored | 12 |
| | Medium-armored | 11 |
| Cavalry knight | Heavy-armored | 8 |
| | Medium-armored | 9 |

-continued

Table of Intervals of Displacement of Units

| Type of Unit | Type of Battle Horse | Interval (inches/turn) |
|---|---|---|
| Squire | Heavy-armored | 9 |
| | Medium-armored | 10 |
| | Light-armored | 11 |

Note: Interval of displacement for infantrymen of any type with a siege ladder is six inches/turn; for those pushing a battering ram is four inches/turn.

Radii of damage delivered to an enemy unit through the use of different projectiles are given in the following table of radii of damage delivered by projectiles Table of Radii of Damage Delivered by Projectiles

| Type of Projectile | Radius of Damage Delivered (in.) | Notes |
|---|---|---|
| Bow arrow | 0 | Damaged area: that intersecting with the active part of the arrow |
| Crossbow arrow | 0 | Damaged area: that intersecting with the arrow |
| Stone projectile | ⅜ | Damaged area: that covered by projectile |
| Flaming projectile | till 1¼ | Degree of damage: <<destroyed>> or <<killed>>. |
| | 1¼–1⅝ | Degree of damage: <<damaged>> or <<wounded>>. |

Efficiency of attack and defense for every unit participating in a "battle" is given in the following table of efficiency of attack and efficiency of defense of a unit.

Table of efficiency of attack and efficiency of defense of a unit.

| Type of Unit | Type of Weapon | Efficiency of Attack (a) | Efficiency of Defense (d) | | |
|---|---|---|---|---|---|
| | | | Armor | Shield | Presence of a bow/crossbow ("+") |
| Cavalry knight | Two-handed sword, mace, battle-ax, lance | 5 | 3 | 1 | |
| Squire (heavy-armored cavalryman) | Two-handed sword, battle-ax, mace | 5 | 2 | 1 | |
| | Sword | 4 | 2 | 1 | + |
| | Lance, sword | 4 | 2 | 1 | |
| Light-armored cavalryman | Two-handed sword, battle-ax, mace | 5 | 1 | — | |
| | Sword | 3 | 1 | 1 | |
| | Sword | 3 | 1 | — | + |
| | Short spear | 3 | 1 | 1 | |
| | Short spear | 3 | 1 | — | + |
| | Long spear | 4 | 1 | — | |
| Infantry knight | Battle-Ax, mace, two-handed sword, halberd | 5 | 3 | 1 | |
| Heavy-armored infantryman | Two-handed sword, battle-ax, mace | 5 | 2 | — | |
| | Sword | 3 | 2 | 1 | |
| | Sword | 3 | 2 | — | + |
| | Long spear | 4 | 2 | — | |
| | Short spear | 2 | 2 | 1 | |
| | Halberd | 5 | 2 | — | |
| Light-armored infantryman | Sword | 2 | 1 | 1 | |
| | Short spear | 2 | 1 | 1 | |
| | Sword | 2 | 1 | — | + |

The players can administer wars that consist of several battles, or separate battles where different strategic moves can be employed. In turn, battles consist of clashes—local military actions, where different tactical moves can be employed.

The rules for administering a battle regulate the order of shooting and troop movement, coordination of hand-to-hand combat, siege of fortifications, entry of reserve units and capture of opponent's units and trophies, all of which approximate the real medieval confrontations, and contain the following points:

If at the beginning of shooting the number of archers on the field is greater than ten, the number of shots available to the players holding the right of turn is 50% of the number of archers (but no less than ten). If the total number of archers is smaller than ten, the number of available shots is the total number of archers on the field.

Bowmen can shoot every turn; crossbowmen can shoot every other turn.

At the beginning of game, a bowman has ten arrows in his possession, a crossbowman has five arrows.

An infantry archer has a right of shot if he has no more than one row of infantrymen of the same army in front of him. A cavalry archer has a right of shot if no more than two rows of infantrymen or one row of cavalry of the same army in front of him. Otherwise, that archer has no shot during a current turn.

If a unit's arm or leg intersects with an active part of bow/crossbow's arrow after a shot, that unit is considered "wounded" and is removed from the battlefield.

If a unit's body or head unprotected by either a shield, a breastplate or a knight's helmet intersects with an active part of a bow's arrow after a shot, that unit is considered "killed" and is dismissed from this and any further battle.

If a unit's body or head unprotected by either a shield or a knight's helmet intersects with a crossbow's arrow after a shot, that unit is considered "killed" and is dismissed from this and any further battle.

A shield or a knight's helmet protects from damage by bow/crossbow's arrow. A breastplate also protects from damage by a bow's arrow.

A light-armored horse is considered "killed" and is dismissed from this and any further battle after two instances of damage by a bow's arrow or one instance of damage by a crossbow's arrow.

A medium-armored horse is considered "killed" and is dismissed from this and any further battle after four instances of damage by a bow's arrow or two instances of damage by a crossbow's arrow.

A heavy-armored horse is considered "killed" and is dismissed from this and any further battle after six instances of damage by a bow's arrow or three instances of damage by a crossbow's arrow.

During shooting, damage to a player's units is equivalent to the damage to opponent's units.

A cavalryman whose horse was "killed" is now considered an infantryman and must lose an item of equipment:

a knight or a squire loses a lance, a light-armored cavalryman armed with a two-handed sword, a battle-ax, a mace or a long spear loses one point from his efficiency of attack number. Else he loses a bow/crossbow or a shield.

After the battle, the winning side can now use weaponry, equipment and war animals, which previously belonged to the opponent and were captured on the battlefield during any further battle.

Any detachments moved past an imaginary line imitating the edge of the battlefield are removed from the current battle but may be used in any further battle.

A catapult can shoot every third turn.

If a stone projectile hits a fortification, any block covered even partly by the projectile is destroyed, creating a breach.

A flaming projectile does no damage to fortification.

Units of the side siege a fortification can enter the fortification if the figure of a unit can fully fit through a breach in the fortification.

Figures of units defending a fortification on the wall are covered by it up to, but no further than their chest.

The substitution of damaged units on the walls with fresh units is conducted during the player's next turn.

Four infantrymen carry each siege ladder.

Six infantrymen move a battering ram used to destroy a fortification's gates.

In order to destroy the gates, at least two blows must be delivered to them with a ram (each blow consists of two moves—the blow itself and the consequent backing up of the battering ram).

Hand-to-hand combat between opposing detachments consists of local clashes between two or several opposing units.

A clash where several units attack one enemy unit is allowed only if the sum of their Efficiencies of Attack is no greater than twice the Efficiency of Defense for the defending unit. In case it is greater or equal to three times the Efficiency of Defense of the defending unit, that unit is captured.

Each side can move no more than half its detachments per turn.

Each detachment can move in any direction, provided it does not split into smaller detachments.

During movement, no part of a unit's figure can be put on top of another unit's figure.

Player can conduct entry of reserve units during any one of their turns.

An entry of reserve units into the area next to the imaginary edge of the battlefield requires one turn.

Reserve units currently located beyond the edge of the battlefield suffer no damage from enemy's projectiles.

The rules for evaluation of military actions are based on relative value of each unit on the field, take into consideration the inherent advantage of attacking side and the element of chance for hand-to-hand combat using standard playing dice, evaluate the success of an attack through accumulation of losses for every detachment and contain the following points.

The result of each clash between two or several units is decided using the following rules:

A quantity S is determined, which equals the difference between the sum A of efficiency of attack a for every attacker and the defensive efficiency d for the defender, each determined from the table of efficiency of attack and efficiency of defense of a unit Standard playing dice are thrown by every player, the number of dice for each player equal to A if that player's units are attacking or d if that player's unit is defending; the sum $S_A$ of numbers on the faces of the attacker' (s') dice is calculated, the sum $S_d$ of numbers on the faces of the defender's dice is calculated, as well as their difference $R=S_A-S_d$.

If $S_A$=>3A and $S_A>S_d$, the defender's losses are calculated.

If $S_A<3A$ and $S_A<S_d$, the attacker's losses are calculated.

If $S_A$=>3A and still $S_A<S_d$, the attacking units flee the battlefield (they may be used in future battles).

If $S_A<3A$ and $S_A$=>$S_d$, the defending unit "avoided the strike" and all the units continue the battle in their previous positions.

The defender's losses are calculates as follows:

The quantity R is compared to a value $R_{table}$, found in the hand-to-hand combat table at the intersection of row and column headed by appropriate values of $S_A$d:

if $R-R_{table}>1$, the defending unit is "killed", if $R-R_{table}=0$ or 1, the defending unit is "wounded", if $R-R_{table}<0$, the defending unit has "avoided the strike".

Hand-to-Hand Combat Table

| | S | | | | | | |
|---|---|---|---|---|---|---|---|
| d | +4 | +3 | +2 | +1 | 0 | −1 | −2 |
| 1 | 3 | 2 | 2 | 1 | — | — | — |
| 2 | — | 4 | 3 | 2 | 2 | — | — |
| 3 | — | 6 | 4 | 3 | 3 | 2 | — |
| 4 | 12 | 8 | 6 | 5 | 4 | 3 | 3 |

The attacker's losses are calculated as follows:

if $S_d=S_A+1$, then the attacker is wounded, if $S_d>S_A+1$, then the attacker is killed.

During both shooting and hand-to-hand combat, penalty points for every detachment are accumulated if a unit from that detachment has been removed from the battlefield according to the following table of unit loss accumulation.

Table of Unit Loss Accumulation

| | Penalty points per unit | | | |
|---|---|---|---|---|
| Type of Unit | Wounded | Killed | Forced to Flee | Captured |
| Light-armored infantryman | 1 | 2 | 1.5 | 1 |
| Heavy-armored infantryman | 2 | 4 | 3 | 2 |
| Light-armored cavalryman | 2 | 4 | 3 | 2 |
| Squire | 3 | 6 | 4.5 | 3 |
| Knight | 4 | 8 | 6 | 4 |

After each side has in turn attacked and defended (either in shooting, clashes or both), the success of military actions is determined through a coefficient of loss W for every detachment. W=B/C, where B is the sum of penalty points from the table of unit loss accumulation and C is the sum of the efficiencies of defense d for every unit in the detachment (either determined at the beginning of the game or recalculated) from the table of efficiency of attack and efficiency of defense of a unit.

In the following table of outcomes of shooting and clashes for a detachment, the outcomes as a result of losses in a detachment are shown, depending on the value of coefficient of loss W of that detachment.

Table of Outcomes of Shooting and Clashes for a Detachment

| Size of Losses' Coefficient (W) | Outcomes |
|---|---|
| 0.9 < W | Detachment surrenders. |
| 0.8 < W <= 0.9 | Detachment flees the battlefield |
| 0.6 < W <= 0.8 | Detachment retreats the distance 1.5 times that of the largest possible move of its speediest unit. C is recalculated based on all remaining units |
| 0.4 < W <= 0.6 | Detachment retreats the distance of the largest possible move of its speediest unit. C is recalculated based on all remaining units |
| W <= 0.4 | Detachment continues the battle in the same position, C remains the same |

With reference to the present invention, the game is played as follow.

Players choose the time and place of a battle, composition of the armies fitting to a chosen historical period, determine the purpose of the battle and the starting positions of detachments with the help of included topographic maps and mark a line on the playing surface (floor), that signifies the edge of the battlefields according to their strategic and tactical considerations. The edge of the battlefield can be marked with a string, chalk, or in any other appropriate way.

The game pieces depicting units, which are part of the starting detachments, are placed on the playing surface within the boundary of battlefield, while those that are part of the reserve are placed outside the boundary.

Afterwards the players throw dice to determine which side makes the first move. The player(s) of that side then announce all the military action (shooting and movements) that is to be conducted during this turn. They conduct shooting by placing the models of projectiles onto the device for imitation of shooting and shoot with a click of a finger. The shooting is conducted according to the rules for administering a battle. If a figure of a unit gets within the damage zone of a given type of projectile, that unit is damaged and is dismissed from the battlefield. The summation of losses during the shooting of the opponent is conducted according to the rules for evaluation of military actions.

After shooting is over, the chosen detachments are moved within the limits of intervals given in the table of intervals of displacement of units, with a help of device for measurement of displacement of units.

If, as a result of displacement, units of a detachment came into direct contact with units of an opposing detachment, hand-to-hand combat is conducted according to the rules for administering a battle. Afterward, the right of turn is given to another side, whose player(s) conduct similar actions in the same order.

Penalty points are counted at the time and in a manner described in the rules for evaluation of military actions.

A battle is considered over if: one side accepts defeat; both sides decide to begin negotiations; one side has lost part of its army, agreed on beforehand, in this case the side which lost more detachments is considered to be the losing side.

A war is considered over if: one of the sides has lost its capital or a part of territory or a part of its army, as agreed for at the beginning of the war.

What is claimed as new and desired to be protected by Letter Patent is set forth in particular in appended claims:

1. A method of playing a historical war game with flat soldiers for at least two players, representing opposing sides, which is conducted on a smooth flat surface, bounded by a line representing the boundary of the battlefield, with a set of flats game pieces (units) which represent figures of warriors, war animals, standards, military equipment and armaments, fortifications, and models of projectiles, corresponding to a certain historical period, a ruler, a support for imitation of shooting, topographical maps and standard playing dice, said method controlled with rules for administering a battle and rules for evaluation of military actions, which take into account equipment, weapons and configuration of detachments, intervals of unit displacement, radii of damage delivery by projectiles, efficiency of attack and defense for different types of units, fitting with a certain historical period, which contains the following steps:

a. agreement between players upon time and place of a battle, composition of the armies, conditions to end the battle and end the war, definition of the purpose of the battle and determination of the initial positioning of detachments with a help of included topographical maps;

b. marking a line on said smooth flat surface, that signifies the said boundary of the battlefield;

c. announcement of the disposition of each detachment by the opposing players;

d. placement of said game pieces by said opposing players on said smooth flat surface within said boundary of the battlefield, according to the disposition of their detachments, while those detachments that are considered as reserve are placed outside said boundary of the battlefield;

e. determination of the side making the first move with draw of standard playing die;

f. conducting moves one side after another, each move consisting of:

i. announcement of all military actions, such as shooting and movement, that is to be conducted during this turn;

ii. shooting by placing said models of projectiles onto said support for imitation of shooting, placing said support on top of the units regarded to be shooting, and making a shot with a click of a finger, shooting being conducted according to said rules for administering a battle, accounting for the fact that if the figure of a unit gets within the damage zone of a given type of projectile, that unit is damaged and is dismissed from the battlefield;

iii. movement of the chosen detachments within the limits of said intervals of unit displacements, according to said rules for administering a battle;

iv. hand-to-hand combat, if it is plausible for a given historical period and if, as a result of displacement, units of a detachment came into direct contact with units of an opposing detachment, according to said rules for administering a battle;

v. evaluation of military action depending on relational losses of each detachment after each side had a right of turn, counted at the time and in a manner described in said rules for evaluation of military actions;

g. agreement to conduct negotiations to end all military actions if one side has lost part of its army, agreed on beforehand, in this case the side which lost more units is considered to be the losing side;

h. end of war as a collection of battles if one of the sides has lost its capital, or a part of territory, or part of its army, as agreed for at the beginning of the game, in this case said side is considered to be the losing side.

2. The method of playing a historical war game, as claimed in claim 1, wherein said rules for administering a battle control:

a. order of shooting;

b. order of detachment movement;

c. rules for hand-to-hand combat;

d. rules for military action at or near said fortifications;

e. conditions for capturing opposing player's units;

f. rules for entry of detachments currently in reserve.

3. The method of playing a historical war game, as claimed in claim 2, wherein said order of shooting for a historical period of second half of fourteenth—first quarter of fifteenth century is controlled by the following rules:

a. if at the beginning of shooting the number of archers on the battlefield is greater than 10, the number of shots available to players holding the right of turn is fifty percents of the number of archers, but no less than ten shots;

b. if the total number of archers is smaller than or equal to ten, the number of available shots is the total number of archers on the battlefield;

c. bowmen can shoot every turn, crossbowmen can shoot every other turn;

d. at the beginning of a battle, a bowman has ten arrows in his possession, a crossbowman has five arrows;

e. an infantry archer has a right of shot if he has no more than one row of infantrymen of the same army in front of him, while a cavalry archer has a right of shot if no more than two rows of infantrymen or one row of the same army cavalrymen in front of him, otherwise an archer has no shot during a current turn.

4. The method of playing a historical war game, as claimed in claim 2, wherein said order of detachment movement for a historical period of second half of fourteenth—first quarter of fifteenth century is controlled by the following rules:

a. each side can move no more than half its detachments per turn;

b. each detachment can move in any direction, provided it does not split into smaller detachments;

c. during movement, no part of a unit's figure can be put on top of another unit's figure.

5. The method of playing a historical war game, as claimed in claim 2 wherein said rules for hand-to-hand combat account for efficiency of attack and defense of units participating and for a historical period of second half of fourteenth—first quarter of fifteenth century, are controlled by the following rules:

a. hand-to-hand combat between opposing detachments consists of local clashes between two or several opposing units, provided that any given unit can attack only one opposing unit;

b. a clash where several units attack one opposing unit is allowed only if the sum of their efficiencies of attack is no greater than twice the efficiency of defense for the defending unit;

c. the number of points on the faces of thrown dice defines immediate efficiency of units participating in a clash, wherein the proportions between the number of dice for attackers and a defender and between the sum of efficiencies of attack for the attackers and the efficiency of defense for the defender are equivalent.

6. The method of playing a historical war game, as claimed in claim 2, wherein said rules for administering a battle at or near said fortifications for a historical period of second half of fourteenth—first quarter of fifteenth century, are controlled by the following rules:

a. a catapult can shoot every third turn;

b. if a stone projectile hits a fortification, any block covered even partly by the projectile is destroyed, creating a breach;

c. a flaming projectile does no damage to a fortification;

d. units of the side storming a fortification can enter the fortification if the figure of a unit can fully fit through a breach in the fortification;

e. figures of units defending a fortification on the wall are covered by it up to, but no further than the chest;

f. The substitution of damaged units on the walls with fresh units is conducted during the player's next turn;

g. each siege ladder is carried by four infantrymen;

h. a battering ram used to destroy a fortification's gates is moved by 6 infantrymen;

i. in order to destroy the fortification gates at least two blows must be delivered to them with a ram, wherein each blow consist of two moves: the blow itself and the consequent backing up of the ram.

7. The method of playing a historical war game, as claimed in claim 2, wherein said rules for entry of detachments currently in reserve for a historical period of second half of fourteenth—first quarter of fifteenth century, are controlled by the following rules:

a. players can conduct entry of reserve units during any turn;

b. entry of reserve units into the area next to the said boundary of the battlefield requires one turn;

c. reserve units currently located beyond the said boundary of the battlefield suffer no damage from opposing projectiles.

8. The method of playing a historical war game, as claimed in claim 2, wherein said conditions for capturing the opposing side's units, trophies for a historical period of the second half of fourteenth—first quarter of fifteenth century is controlled by the following rules:

a. In a clash where several units attack one opposing player's unit and the sum of their efficiencies of attack is greater or equal to three times the efficiency of defense of the defending unit, that unit is considered to be captured;

b. If the distance between the attacked unit and the nearest unit of its own army is equal to 2 inches or less, that unit cannot be captured;

c. Units of the player's army that participated in the capturing of the opposing player's unit cannot capture another opposing player's unit during the same turn;

d. The entire detachment can be captured depending on the particular value of said coefficient of loss W of that detachment.

9. The method of playing a historical war game, as claimed in claim 1, wherein said rules for evaluation of military actions are based on the evaluation of losses suffered by each side during shooting or hand-to-hand combat.

10. The method of playing a historical war game, as claimed in claim 9, wherein said evaluation of losses suffered by each side during shooting or hand-to-hand combat for a historical period of second half of fourteenth—first quarter of fifteenth century, is controlled by the following rules:

a. loss of units dismissed from the battlefield is quantified through penalty points and depends on the type of unit;

b. success of military action is determined through a coefficient of loss for every detachment, such that $W=B/C$, where B is the sum of the penalty points, corresponding to detachment's losses, and C is the sum of said efficiencies of defense for every unit in the detachment, either determined at the beginning of the game or recalculated after the previous military action's evaluation;

c. outcome of losses suffered, depending on the value of said coefficients of loss W of that detachment, can be one of the following:

i. detachment surrenders;

ii. detachment flees the battlefield;

iii. detachment retreats the distance one and a half times that of the largest possible move of its speediest unit;

iv. detachment retreats the distance of the largest possible move of its speediest unit;

v. detachment continues the battle in the same position.

* * * * *